US009809986B2

(12) United States Patent
Titcomb et al.

(10) Patent No.: US 9,809,986 B2
(45) Date of Patent: Nov. 7, 2017

(54) STRING HOLDER FOR USE WITH CONCRETE FORMING PRODUCTS

(71) Applicant: Titcomb Brothers Manufacturing, Inc., Westport, MA (US)

(72) Inventors: Ted Titcomb, East Sandwich, MA (US); Paul S. Titcomb, Westport, MA (US)

(73) Assignee: Titcomb Brothers Manufacturing, Inc., Westport, MA (US)

( * ) Notice: Subject to any disclaimer, the term of this patent is extended or adjusted under 35 U.S.C. 154(b) by 103 days.

(21) Appl. No.: 15/013,270

(22) Filed: Feb. 2, 2016

(65) Prior Publication Data

US 2016/0222684 A1 Aug. 4, 2016

Related U.S. Application Data

(60) Provisional application No. 62/110,863, filed on Feb. 2, 2015.

(51) Int. Cl.
*E04G 17/00* (2006.01)
*E04G 21/18* (2006.01)

(52) U.S. Cl.
CPC ..... *E04G 21/1833* (2013.01); *E04G 17/001* (2013.01)

(58) Field of Classification Search
CPC . E04G 21/00; E04G 21/1808; E04G 21/1816; E04G 21/1825; E04G 21/1833; G01B 11/02; G01B 11/303
USPC ..... 33/404–410, 413
See application file for complete search history.

(56) References Cited

U.S. PATENT DOCUMENTS 2,030,539 A * 2/1936 Riley ..... E04G 21/1825 33/410
2,665,487 A * 1/1954 Mastrella ..... E04G 21/1825 33/408
2,801,818 A * 8/1957 Wojdyla ..... E04F 21/26 33/404
2,855,681 A * 10/1958 Andrews ..... E04G 21/1808 33/406
2,893,125 A * 7/1959 Kampel ..... E04G 21/1808 33/407
3,039,195 A * 6/1962 Litty ..... E04G 21/1825 33/404
3,102,339 A * 9/1963 Pagona ..... E04G 21/1825 33/410
3,130,500 A * 4/1964 Bongiovanni ..... E04G 21/1816 33/406
3,408,742 A * 11/1968 Caprio ..... E04G 21/1825 33/409

(Continued)

*Primary Examiner* — Yaritza Guadalupe-McCall
(74) *Attorney, Agent, or Firm* — Nelson Mullins Riley & Scarborough LLP; Anthony A. Laurentano

(57) ABSTRACT

A string holder for use with concrete forms comprising a main body having a central portion and first and second wing type portions that are coupled to the central portion. The central portion includes a first axial arm extending in a first direction and a second axial arm extending in a second direction opposite to the first direction, wherein the first axial arm has formed thereon one or more grooves sized and dimensioned for accommodating a string. The first wing type portion and the second wing type portion are angled relative to the central portion and extend radially outwardly therefrom. Each of the wing type portions includes a radial arm and a further axial arm.

9 Claims, 4 Drawing Sheets

(56) References Cited

U.S. PATENT DOCUMENTS

| | | | | |
|---|---|---|---|---|
| 4,031,627 | A * | 6/1977 | Dar | E04G 21/1825 33/409 |
| 2008/0000096 | A1* | 1/2008 | Wade | E04G 21/1833 33/404 |
| 2008/0222908 | A1* | 9/2008 | Bittner | G01C 15/12 33/404 |
| 2009/0320306 | A1* | 12/2009 | Clancy | E04G 21/1825 33/408 |
| 2012/0222322 | A1* | 9/2012 | Agnew | E04G 21/1825 33/409 |
| 2015/0368918 | A1* | 12/2015 | Otto | E04G 21/1825 33/518 |
| 2016/0222684 | A1* | 8/2016 | Titcomb | E04G 17/001 |

* cited by examiner

STRING HOLDER FOR USE WITH CONCRETE FORMING PRODUCTS

RELATED APPLICATION

This application claims priority to U.S. provisional patent application Ser. No. 62/110,863, filed on Feb. 2, 2015, entitled Apparatuses and Methods For Use With Concrete Forming Products, the contents of which are hereby incorporated by reference.

FIELD OF THE INVENTION

The present invention is related to the fabrication of concrete walls, such as for home foundations, using suitable concrete forms, and particularly to a device and apparatus employed in connection with the concrete forms for aligning and forming the concrete walls.

BACKGROUND OF THE INVENTION

Conventional concrete walls may be created by pouring concrete into a suitable concrete form. As is known in the art, concrete foundation walls are generally poured between two sets of concrete forms disposed in essentially parallel relationship and defining therebetween a channel having a dimension for the desired thickness of the concrete wall. Such opposed, spaced apart walls are generally held in a fixed relationship relative to each other against the immense weight of any poured concrete by tie-wires and turnbuckle assemblies having abutment surfaces against which a locking or latching arm on adjacent form sections abut. Once assembled into the shape of the wall, wet concrete is poured into the channel formed between the concrete forms and allowed to dry. The concrete forms typically comprise multiple form panels, which may for example be formed of wood or any other suitable well known material. The height of the form panel may vary by application.

Multiple form panels may be placed side-by-side in order to construct a wall of a desired length. Because the wet poured concrete takes the shape of the forms in which it is placed, the finished concrete wall corresponds in configuration to the assembled form. Therefore, it is important to align precisely the panels composing the concrete form in order to ensure that the finished wall has the desired appearance and strength.

One problem that arises when employing concrete forms to create a concrete foundation wall involves failing to accurately align the form panels side-by-side and/or top-to-bottom so that the wall is not straight in either direction. Conventionally, in order to align the panels, nails may be driven into the sides of the end panels that form the wall, at the corners of the wall. A string may be hung between the nails in the corners. Because the string forms a straight line, the other panels in the wall may be aligned to the string in order to ensure that the wall is straight.

The solution, however, is not optimal for several reasons. For example, the best location to place a nail in this configuration, in order to most accurately align the panels, is in the precise corner where two panels meet. Because this location is necessarily provided at the space between two panels, there is no place at which a nail can be securely driven into a panel at this location. This means that the nail is either driven into a less-suitable location (e.g., offset from the corner), which makes alignment less accurate, or is left in the unstable location between the panels, which can cause the nail to easily fall out, thereby making alignment more difficult and time-consuming. Moreover, the form panels are typically reusable for a certain number of pours, which helps to reduce the costs of construction. Driving a nail into the form panels reduces their useful lifespan, which increases overall costs.

Another problem that can occur when employing concrete forms involves straightening the panels so that they do not lean inwards or outwards. For this purpose, and for securing the panels together, some panels include one or more panel bars that extend horizontally across the panel. The panel bars may be, for example, metal bars about 2 inches wide that are affixed to the form panel. If multiple panel bars are provided on a single panel, they may be spaced at predetermined locations along the height of the form panel.

The panel bar may include a latch or lever that allows the panels to be clipped together side-by-side, as well as a plurality of shoulder bolts. A turnbuckle can be mounted to the panel bar in the vicinity of the shoulder bolts, with for example, the shoulder bolt positioned to the left of the turnbuckle and the latch on the right of the turnbuckle. The turnbuckle may contact the shoulder bolt in order to hold the turnbuckle in place. Further, the turnbuckle may be attached to one end of a bracing arm. The other end of the bracing arm can be secured to the ground in front of the form. By adjusting the length of the turnbuckle for one or more panel arms on the form panel, the amount of lean or tilt in the panel may be changed. Accordingly, the panel can be aligned so as to be vertical (if a vertical alignment is desired). Problematically, there is no single standard location for the shoulder bolts formed on the panel bar. Thus, turnbuckles that are well-suited to use with one type of panel bar are not well suited for use with another panel bar made by a different manufacturer.

SUMMARY OF THE INVENTION

The present invention is directed to a string holder for use with concrete forms, comprising a main body having a central portion and first and second wing type portions that are coupled to the central portion. The central portion includes a first axial arm extending in a first direction and a second axial arm extending in a second direction opposite to the first direction, wherein the first axial arm has formed thereon one or more grooves sized and dimensioned for accommodating a string. The first wing type portion and the second wing type portion are angled relative to the central portion and extend radially outwardly therefrom.

The first wing type portion includes a first radial arm that is coupled at one end to the central portion and extends outwardly therefrom and is disposed so as to be perpendicular to the central portion, and a third axial arm coupled to an end opposite to the end coupled to the central portion and extends in the second direction, which is perpendicular to the direction of the first radial arm. The first radial arm includes a flange portion that has an aperture formed therein. Similarly, the second wing type portion includes a second radial arm that is coupled at one end to the central portion and extends outwardly therefrom and is disposed so as to be perpendicular to the central portion, and a fourth axial arm that is coupled to an end opposite to the end coupled to the central portion and extends in the second direction, which is perpendicular to the direction of the second radial arm. The second radial arm includes a flange portion that has an aperture formed therein.

The first axial arm comprises a plurality of grooves formed on each side of the first axial arm. Further, the second axial arm of the central portion is sized and dimensioned for engaging with an inside corner formed by an adjacent pair of forms arranged at a selected angle relative to each other when mounted thereto. Also, the third axial arm and the fourth axial arm are each sized and dimensioned for contacting outer surfaces of the forms when mounted thereto.

The exemplary embodiments will now be described in detail with reference to the attached drawings.

BRIEF DESCRIPTION OF THE DRAWINGS

These and other features and advantages of the present invention will be more fully understood by reference to the following detailed description in conjunction with the attached drawings in which like reference numerals refer to like elements throughout the different views. The drawings illustrate principals of the invention and, although not to scale, show relative dimensions.

DETAILED DESCRIPTION

Exemplary embodiments of the present invention describe components or tools for use with concrete forming products.

Figure 1:
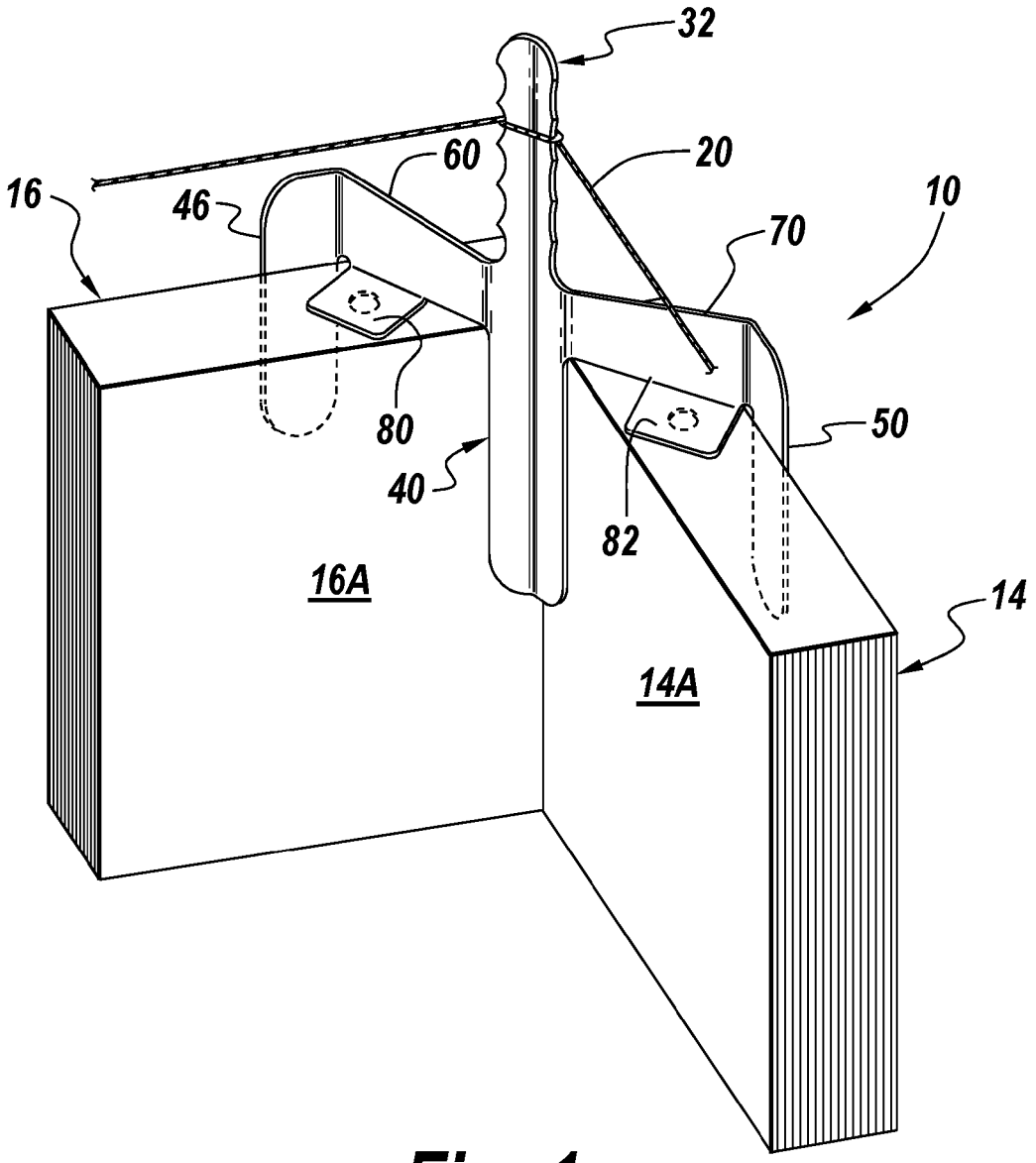
FIG. 1 is a perspective view of a string holder according to the teachings of the present invention in a deployed configuration on top of a pair of concrete forms.
Figure 3:
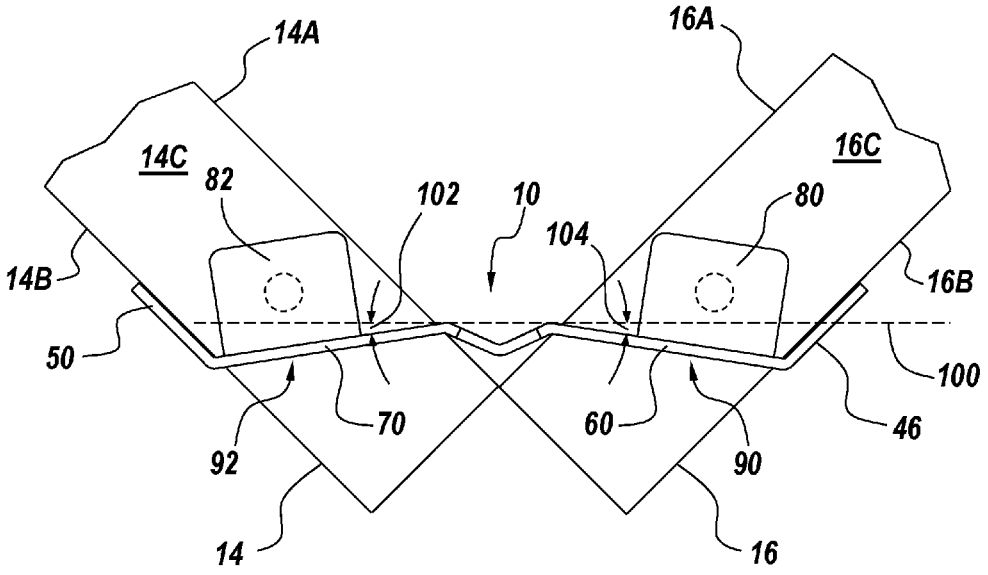
FIG. 3 is a top perspective view of the string holder of FIG. 1 according to the teachings of the present invention.

According to a first embodiment of the present invention, a string holder 10 is provided for aligning multiple concrete forms 14 and 16 as shown in FIGS. 1 and 3. The concrete forms 14 and 16 can have any selected shape and are preferably in the shape of a panel. The forms can be made of any suitable material, such as wood, as is known in the art. The forms can be of any selected thickness, and include forms having a thickness of about 1.125 inches. The present string holder 10 is sized and configured for mounting at a corner junction of the forms, as shown. When mounted thereto, the string holder 10 secures and retains in place, either alone or in conjunction with other fasteners, the forms. Further, the illustrated string holder 10 also helps align the forms relative to each other so that the forms are perpendicular to each other so as to form in general a right angle. Due to the overall shape and configuration of the string holder 10, an alignment element, such as for example a string 20, may be attached to the string holder at a precise location that is most suited for aligning the forms relative to each other. Moreover, the string holder has a relatively small footprint compared to conventional solutions, allowing it to be nested and carried more easily and manufactured in a more cost effective manner. Still further, damage to reusable form panels is reduced as compared to conventional solutions. It should be noted that the term "string" as used herein refers to general string-like elements or bodies that are flexible and resilient and if needed can be tied, which includes not only string, yarn, wire and cable, but also a tape, belt and the like.

Figure 2:
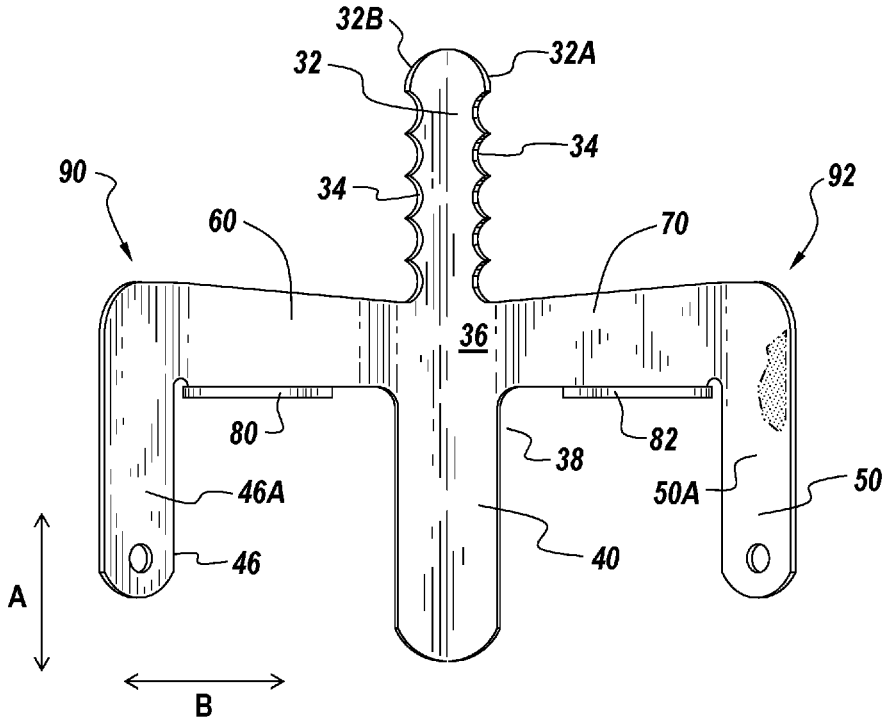
FIG. 2 is a schematic rear view of the string holder of FIG. 1 according to the teachings of the present invention.

The illustrated string holder 10 is described herein with reference to an axial direction and a radial direction. For purposes of discussion, the term "axial direction" as used herein refers to an axis drawn through the string holder in a vertical gravitational direction when the string holder is mounted for example on a form (e.g., in a direction indicated by the arrow "A" in FIG. 2). The term "radial direction" as used herein refers to a direction that is generally or substantially perpendicular to the axial direction (e.g., in a direction indicated by the arrow "B" in FIG. 2).

With reference to FIGS. 1-4, the string holder 10 of the present invention has a main body 30 that has a generally centrally located central region 38. The central region 38 is bent or curved in a selected manner, and is bent in a generally C-shaped manner, as shown in FIG. 3. Those of ordinary skill in the art will readily recognize that the central region 38 can be bent in any suitable manner that allows at least a portion of the central region to be mounted along the inner wall or face of the forms 14, 16. The central region 38 comprises a first axial arm 32 that extends axially upwardly (e.g., a first direction) from a midpoint region 36 of the string holder. The first axial arm 32 forms a generally tab like extension having a series of paired grooves 34 formed on opposed edges 32A, 32B of the first axial arm 32. The grooves 34 are sized and dimensioned to seat a string when coupled thereto by a user at different vertical heights, and hence forms an alignment feature of the string holder. The overall length of the first axial arm 32 may be determined by the application and by the nature of the alignment element (e.g., string) to be used. For example, the first axial arm 32 may be made longer if the alignment element is expected to sag relatively more than other types of alignment elements, and/or if the string holder is expected to be used to align relatively long lengths of wall (in which case, the sag in the alignment element is necessarily greater than for a shorter run of wall).

The central region 38 also includes a second axial arm 40 extending from substantially the midpoint 36 of the string holder in a downward direction (e.g., a second direction) that is substantially opposed to the first direction. The second axial arm 40 may be configured to engage with the corner formed by a pair of adjacent concrete forms 14, 16. In particular, the second axial arm 40 is adapted to contact the inner wall or face 14A, 16A of the forms. The length of the second axial arm 40 is sufficient to allow the holder to be properly mounted to the forms so as to provide sufficient structural stability when a string is used therewith.

The main body 30 further includes a pair of opposed first and second wing type sections 90 and 92, respectively, which are attached to the central region 38 of the main body 30 at the midpoint 36. The first wing type section 90 includes a first radial arm 60 that extends in a direction perpendicular to the direction of the first and second axial arms 32 and 40. The first radial arm 60 is angled relative to an imaginary axis 100 (FIG. 3) that is tangential to the rear curved surface of the central region 38 of the string holder 10. The radial arm 60 relative to the axis 100 forms an angle 102 that is between about 10 degrees and about 14 degrees, and preferably is about 12 degrees. Those of ordinary skill in the art will readily recognize that the angle 102 can be varied to accommodate forms of varying thicknesses and/or to accommodate corners of different shapes. The first radial arm 60 also includes an optional flange 80 that is adapted to be mounted to an upper end surface 16C of the form 16. The flange 80 can include if desired an optional aperture 84 for seating any suitable type of fastener. The fastener helps secure the first wing type section 90 to the form 16.

The first wing type section 90 also includes a third axial arm 46 that extends axially downwardly relative to the first radial arm 60 in the same direction as the second axial arm. When mounted to the forms, the inner surface 46A of the third axial arm 46 contacts the outer surface 16B of the form 16. The third axial arm 46 is intended to help mount and stabilize the string holder when mounted to the forms 14, 16.

The second wing type section 92 is similar to the first wing type section 90. The second wing type section 92 is also attached to the central region 38 of the string holder main body 30 at the midpoint 36. The second wing type section 92 includes a second radial arm 70 that extends in a direction perpendicular to the direction of the first and second axial arms 32 and 40. The second radial arm 70 is also angled relative to the axis 100 (FIG. 3). The illustrated second radial arm 70 forms an angle 104 relative to the axis 100 that is about the same as the angle 102. The second radial arm 70 can also include an optional flange 82 that is adapted to be mounted to an upper end surface 14C of the form 14. The flange 82 can also include an optional aperture 86 for seating any suitable type of fastener to help secure the second wing type section 92 to the form 14. Those of ordinary skill in the art will readily recognize that the angles 102 and 104 can also be different relative to each other.

The second wing type section 92 also includes a fourth axial arm 50 that extends axially downwardly relative to the second radial arm 70 in the same direction as the second axial arm 40. When mounted to the forms, the inner surface 50A of the fourth axial arm 50 contacts the outer surface 14B of the form 14. The fourth axial arm 50 is also intended to help mount and stabilize the string holder when mounted to the forms 14, 16.

The first and second axial arms may be configured with respect to the other elements of the string holder so as to position the alignment element deployed between the first axial arms of two connected string holders over the intended inside edge of a form (as shown in FIG. 1). As described above, the string holder 10 includes first and second radial arms 32, 40 extending from substantially the midpoint 36 of the string holder. In some embodiments, when deployed on a form, the first and second radial arms may sit on top of the edge of the attached forms. When positioned at a corner formed by a pair of adjacent forms 14, 16 that are oriented perpendicularly relative to each other the optional flanges 80, 82 contact the top end 14C, 16C of the forms. The apertures 80, 82 if provided are located on the flange so as to position the hole substantially over the center of the top of the form panel in the width direction. This may provide a mounting location so that a fastening mechanism, such as a nail, can be driven into the hole. This allows for the string holder 10 to be securely affixed to the form panels 14, 16, in the event that a more secure attachment is necessary (e.g., due to environmental conditions). However, the use of a fastening mechanism is optional, since the string holder 10 is shaped to remain in place on the corner of the form panel under most conditions. To that end, some or all of the main body 30 of the string holder 10 can have a textured surface to help retain the holder in place through a frictional fit. The textured surface can include, for example a textured powder coat finish. Additionally, those of ordinary skill in the art will readily recognize that the lengths of the various axial and radial arms can vary from what is disclosed and described herein. For example, the third and fourth axial arms 46 and 50 can vary in length and can have different lengths relative to each to other. Further, the length of the third and fourth axial arms 46 and 50 can be the same as, longer or shorter than the length of the second axial arm 40.

Figure 4:
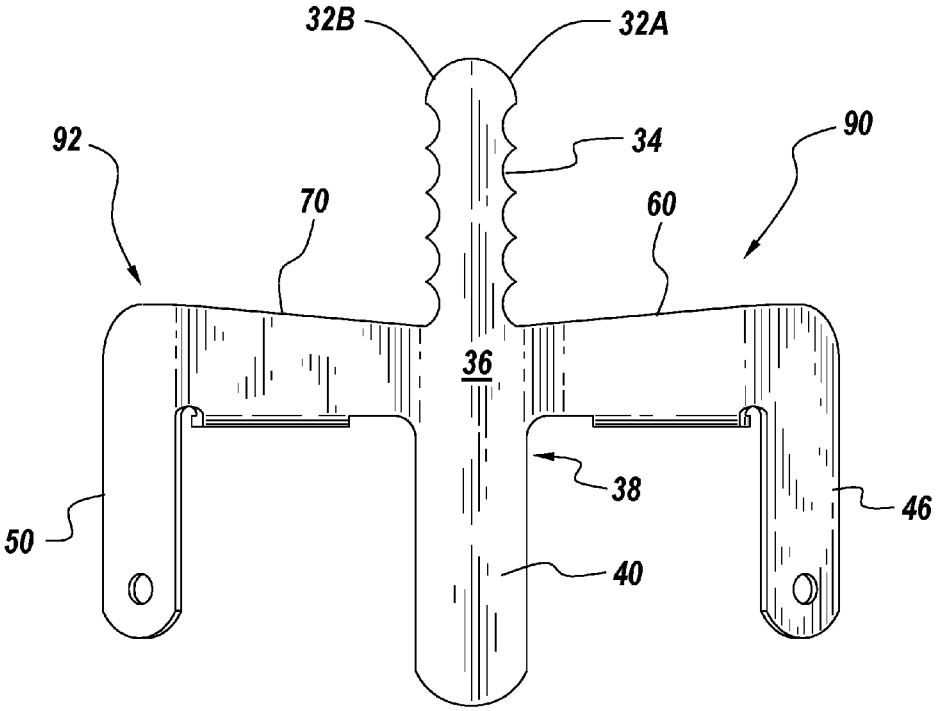
FIG. 4 is a front schematic view of the string holder of FIGS. 1 and 2 according to the teachings of the present invention.

Alternatively or in addition, as shown in FIG. 4, the third axial arm 46 and the fourth axial arm 50 can include apertures as shown that are sized to seat fasteners. The fasteners can operate if desired in addition to the fasteners mounted in the flange holes, or can replace the flange holes to help secure the string holder to the forms 14, 16. Such a configuration allows the fastening elements to be driven into the side of the form panels, rather than the top, which may help to extend the useful life of the form panels. The above described apertures for receiving the fasteners may be about 3/16" in diameter.

As also noted above, the third and fourth axial arms 46, 50 may be located at the ends of the first and second radial arms 60 and 70, respectively. The third and fourth axial arms 46, 50 may engage with the outer surfaces 14B, 16B of the forms 14, 16 in order to hold or secure the string holder 10 in place. As shown in FIG. 3, the third and fourth axial arms may be angled with respect to the first and second radial arms (respectively) so as to align the third and fourth axial arms to the back surface(s) of the forms.

The interior length of the first and second radial arms 60, 70 (i.e., the lengths as measured from the outer edge of the second axial arm 40 to the interior edges of the third and fourth axial arms, respectively) may be selected so as to accommodate and seat securely with a predetermined shape of a form panel, as shown in FIGS. 1 and 3. For example, the length may be selected so as to accommodate 1.125 inch plywood form panels that are arranged at right angles relative to each other. The lengths of the second, third, and fourth axial arms may be configured so as to provide a sufficiently stable base for the first axial arm to rest upon. For example, the lengths of the second, third, and fourth axial arms may be selected so as to keep the string holder securely attached to the form panels even when the string or other fastening mechanism is pulled during the course of alignment.

The string holder 10 may be made of a relatively flexible material, and may make use of its flexible properties to maintain friction to resist movement and hold itself in place. These flexible properties may also allow for a certain amount of flexibility in terms of the thickness of the form panel that the string holder 10 attaches to, or the angle of the corner that the string holder attaches to. Alternatively, the string holder 10 can be made from a relatively rigid material, such as metal, that provides a strong, rigid, and stable securing mechanism for a string.

With this flexibility in mind, the string holder lo should be rigid enough to maintain its shape in order to ensure accurate alignment of the forming panels while resisting bending due to normal wear-and-tear during use and transport. For example, according to one embodiment, the string holder may be made of spring steel. Depending on the application, the string holder may be made of metal, plastic, or any other suitable material.

It will thus be seen that the invention efficiently attains the objects set forth above, among those made apparent from the preceding description. Since certain changes may be made in the above constructions without departing from the scope of the invention, it is intended that all matter contained in the above description or shown in the accompanying drawings be interpreted as illustrative and not in a limiting sense.

It is also to be understood that the following claims are to cover all generic and specific features of the invention described herein, and all statements of the scope of the invention which, as a matter of language, might be said to fall therebetween.

Having described the invention, what is claimed as new and desired to be secured by Letters Patent is:

1. A string holder for use with forms, comprising a main body having a central portion, and first and second wing type portions that are coupled to the central portion, wherein the central portion includes a first axial arm extending in a first direction and a second axial arm extending in a second direction opposite to the first direction, wherein the first axial arm has formed thereon one or more grooves sized and dimensioned for accommodating a string, wherein the first wing type portion and the second wing type portion are angled relative to the central portion and extend radially outwardly therefrom, the first wing type portion includes a first radial arm that is coupled at one end to the central portion and extends outwardly therefrom and is disposed so as to be perpendicular to the central portion, and a third axial arm coupled to an end opposite to the end coupled to the central portion and extends in the second direction, which is perpendicular to the direction of the first radial arm, and the second wing type portion includes a second radial arm that is coupled at one end to the central portion and extends outwardly therefrom and is disposed so as to be perpendicular to the central portion, and a fourth axial arm that is coupled to an end opposite to the end coupled to the central portion and extends in the second direction, which is perpendicular to the direction of the second radial arm.

2. The string holder of claim 1, wherein each of the first radial arm and the second radial arm includes a flange portion.

3. The string holder of claim 2, wherein each of the flange portions has an aperture formed therein.

4. The string holder of claim 1, wherein the first axial arm comprises a plurality of grooves formed on each side of the first axial arm.

5. The string holder of claim 1, wherein each of the third axial and the fourth axial arm has an aperture formed therein.

6. The string holder of claim 1, wherein the first wing type portion is angled relative to an imaginary axis that is tangential to the central portion to form an angle in a range between about 10 degrees and about 14 degrees.

7. The string holder of claim 1, wherein the second wing type portion is angled relative to an imaginary axis that is tangential to the central portion to form an angle in a range between about 10 degrees and about 14 degrees.

8. The string holder of claim 1, wherein the second axial arm of the central portion is sized and dimensioned for engaging with an inside corner formed by an adjacent pair of forms arranged at a selected angle relative to each other when mounted thereto.

9. The string holder of claim 8, wherein the third axial arm and the fourth axial arm are each sized and dimensioned for contacting outer surfaces of the forms when mounted thereto.

* * * * *